US005767833A

United States Patent [19]

Vanderwiele et al.

[11] Patent Number: 5,767,833

[45] Date of Patent: Jun. 16, 1998

[54] METHOD AND SYSTEM FOR PROVIDING EXTERNAL BITMAP SUPPORT FOR DEVICES THAT SUPPORT MULTIPLE IMAGE FORMATS

[75] Inventors: Mark W. Vanderwiele; Michael R. Cooper; R. Ravisankar, all of Boca Raton, Fla.

[73] Assignee: International Business Machines Corporation, Armonk, N.Y.

[21] Appl. No.: 495,140

[22] Filed: Jun. 28, 1995

[51] Int. Cl.[6] ..... G09G 5/02

[52] U.S. Cl. ..... 345/132; 345/153

[58] Field of Search ..... 345/3, 132, 153–155, 345/428; 395/128; 348/445

[56] References Cited

U.S. PATENT DOCUMENTS

| | | | |
|---|---|---|---|
| 4,974,171 | 11/1990 | Yeh et al. . | |
| 5,168,552 | 12/1992 | Vaughn et al. . | |
| 5,319,473 | 6/1994 | Harrington . | |
| 5,343,311 | 8/1994 | Morag et al. . | |
| 5,373,375 | 12/1994 | Weldy . | |
| 5,475,400 | 12/1995 | Sellers et al. | 345/155 |
| 5,481,276 | 1/1996 | Dickey et al. | 345/132 |
| 5,502,458 | 3/1996 | Braudaway et al. | 345/153 |

OTHER PUBLICATIONS

IBM Technical Disclosure Bulletin, vol. 37, no. 02B, Feb. 1994, A. Key et al., "Concealing Data Within a Bitmap", pp. 413 and 414.

*Primary Examiner*—Jeffrey Brier

*Attorney, Agent, or Firm*—Mark S. Walker; Andrew J. Dillion

[57] ABSTRACT

A method and system for providing external bit map support to device drivers coupled to a data processing system are disclosed. The data processing system includes a central processing unit, memory, user output device, and a user input device. The method and system also provide outputting of an image under a graphical user interface on the display device. In implementing the improved external bit map support, the system and method generate an image through the graphical user interface in device independent bits format and then determine whether the image is to be supported in an external bit map format. If the image is to be supported in an external bit map form, the system determines the level of required resolution for supporting that image and then converts that image to the external bit map format at that desired level of resolution. The desired level of resolution is selectable from either 24 bits per PEL (bpp), 8 bpp or 4 bpp. Further, if the image is not to be supported in the external bit map format, the system then converts the image to a standard bit map support format. Additionally, the system then determines whether the image is targeted for multiple hardware formats or a single hardware format and then provides a conversion from device independent bits to device dependent bits formats in the case of the multiple hardware format targeting, or performing image conversion appropriate for the single device in the case of the single device targeting. Finally, the system forwards the converted image to either the multiple hardware devices or the single hardware device according to the prior determination.

17 Claims, 5 Drawing Sheets

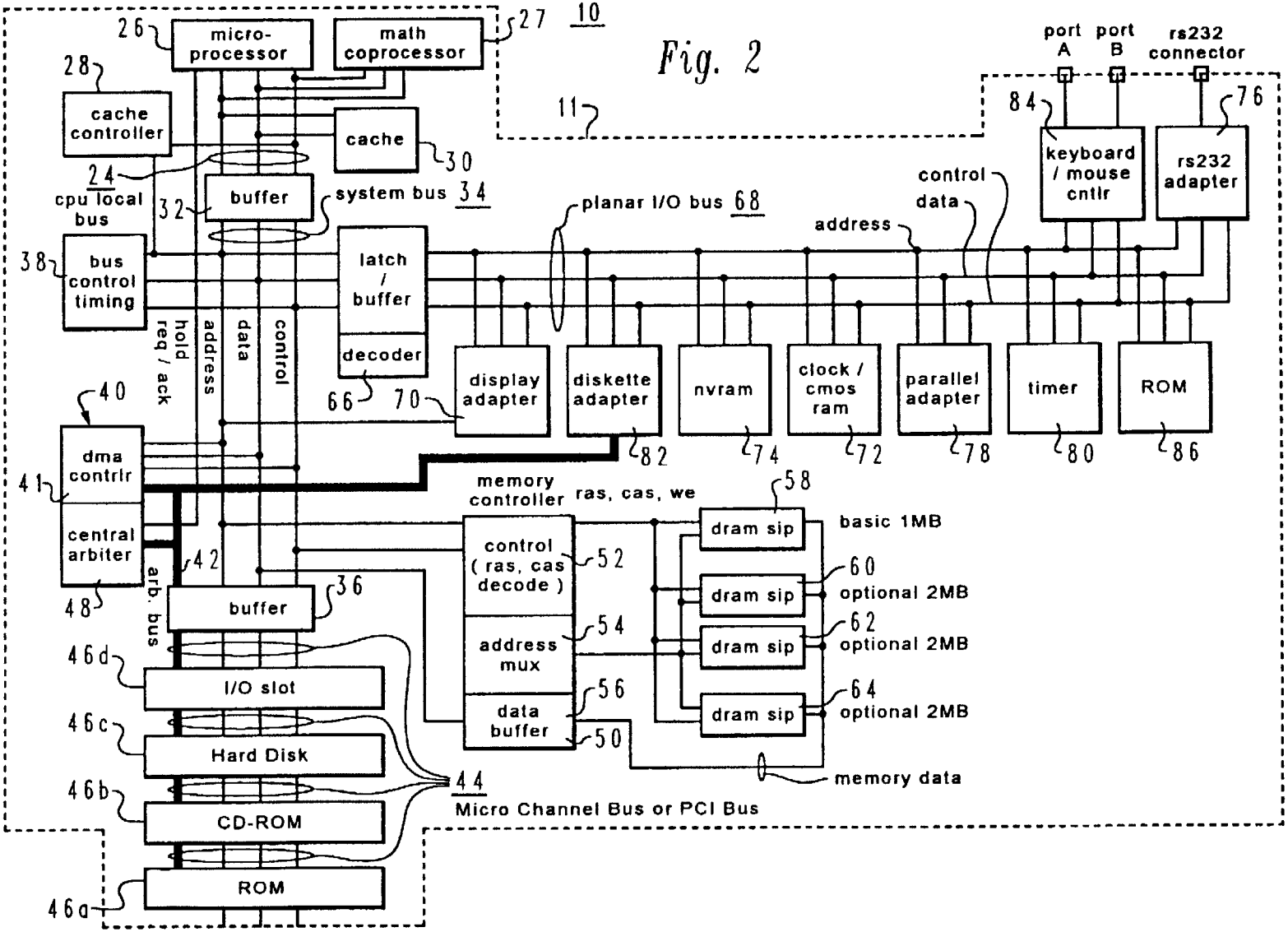
Fig. 2
10
11
27
26
28
24
cpu local bus
cache controller
micro-processor
math coprocessor
cache
30
system bus 34
buffer
32
bus control timing
38
latch / buffer
decoder
66
70
planar I/O bus 68
address
control
data
hold req / ack
port A
port B
rs232 connector
keyboard / mouse cntlr
84
rs232 adapter
76
ROM
86
timer
80
parallel adapter
78
clock / cmos ram
72
nvram
74
diskette adapter
82
display adapter
dma contrlr
40
41
central arbiter
48
arb. bus
42
buffer
36
memory controller
control ( ras, cas decode )
52
address mux
54
data buffer
56
50
ras, cas, we
dram sip
58
basic 1MB
60
optional 2MB
62
optional 2MB
64
optional 2MB
memory data
44
Micro Channel Bus or PCI Bus
I/O slot
46d
Hard Disk
46c
CD-ROM
46b
ROM
46a

METHOD AND SYSTEM FOR PROVIDING EXTERNAL BITMAP SUPPORT FOR DEVICES THAT SUPPORT MULTIPLE IMAGE FORMATS

BACKGROUND OF THE INVENTION

1. Technical Field

The present invention relates generally to a data processing system that is capable of processing, storing, and displaying color information of an image and, more particularly, to a data processing system that is capable of using actual scanned or digitized color values, or both, to pass on to an output device through a graphical user interface (GUI). Additionally, the present invention relates to a data processing system that is able to provide external bit map support for multiple devices that support multiple image formats, thus reducing system memory overhead for those devices that support the multiple color depths.

2. Description of the Related Art

The use of color images in computer systems is becoming increasingly widespread as computing power has increased and computer users have become more sophisticated. The use of color images, however, is not limited to professionals using high-end computer systems, and, instead it is quickly becoming a standard feature personal computers has used by all levels of computer users.

With today's technology, providing realistic color image has numerous difficulties. Color display screens are capable of rendering a wider range of colors than can be rendered by output devices because of the different way in which the output devices are addressed compared to the color display.

Another difficulty with providing realistic color imaging on computer display screens is the considerable computing power required to manage the large amount of information that an electronic color image contains. Furthermore, present data processing systems using color displays generate graphical user interfaces to aid the user in accessing information or processing information or using the data processing system in general. Although the GUIs make it easier for the user to use the system they introduce another layer between the actual processing of information and the user's intentions or input. With this added layer also comes limitations in increased memory usage when it comes to inputting color images into the data processing system by either scanning the images or digitizing the color images or both. Once the images are in the system, then they are passed on the an output devices through the GUI. Current data processing systems that use GUIs have to trade off between keeping external color values with increased memory usage or mapping the external color values to an internal palette or look-up table, thus loosing color, in order to minimize memory usage.

Accordingly, what is needed is a system and method that allow images that are defined in a particular color palette, different from the GUIs default color palette, without incurring the cost of storing the image internally as a TRUE color image, which is 24 bit per pixel element (PEL) (bpp). Additionally, what is needed is a method and system that provides high quality output, rivaling the original image quality, across all devices serviced by the data processing system, without suffering performance penalties.

SUMMARY OF THE INVENTION

It is therefore one object of the present invention to provide a data processing system that is capable of processing, storing, and displaying color information of an image.

It is another object of the present invention to provide a data processing system that is capable of using actual scanned or digitized color values, or both, to pass on to an output device through a graphical user interface (GUI).

It is yet another object of the present invention to provide a data processing system that is able to provide external bit map support for multiple devices that support multiple image formats thus reducing system memory overhead for those devices that support the multiple color depths.

According to the present invention, a method and system for providing external bit map support to device drivers coupled to a data processing system are disclosed. The data processing system includes a central processing unit, memory, user output device, and a user input device. The method and system also provide outputting of an image under a graphical user interface on the display device. In implementing the improved external bit map support, the system and method generate an image through the graphical user interface in device independent bits format and then determine whether the image is to be supported in an external bit map format. If the image is to be supported in an external bit map form, the system determines the level of required resolution for supporting that image and then converts that image to the external bit map format at that desired level of resolution. The desired level of resolution is selectable from either 24 bits per PEL (bpp), 8 bpp or 4 bpp. Further, if the image is not to be supported in the external bit map format, the system then converts the image to a standard bit map support format. Additionally, the system then determines whether the image is targeted for multiple hardware formats or a single hardware format and then provides a conversion from device independent bits to device dependent bits formats in the case of the multiple hardware format targeting, or performing image conversion appropriate for the single device in the case of the single device targeting. Finally, the system forwards the converted image to either the multiple hardware devices or the single hardware device according to the prior determination.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 2 is a block diagram of personal computer system illustrating the various components of personal computer system in accordance with the present invention.

DETAILED DESCRIPTION OF THE PREFERRED EMBODIMENT

Figure 1:
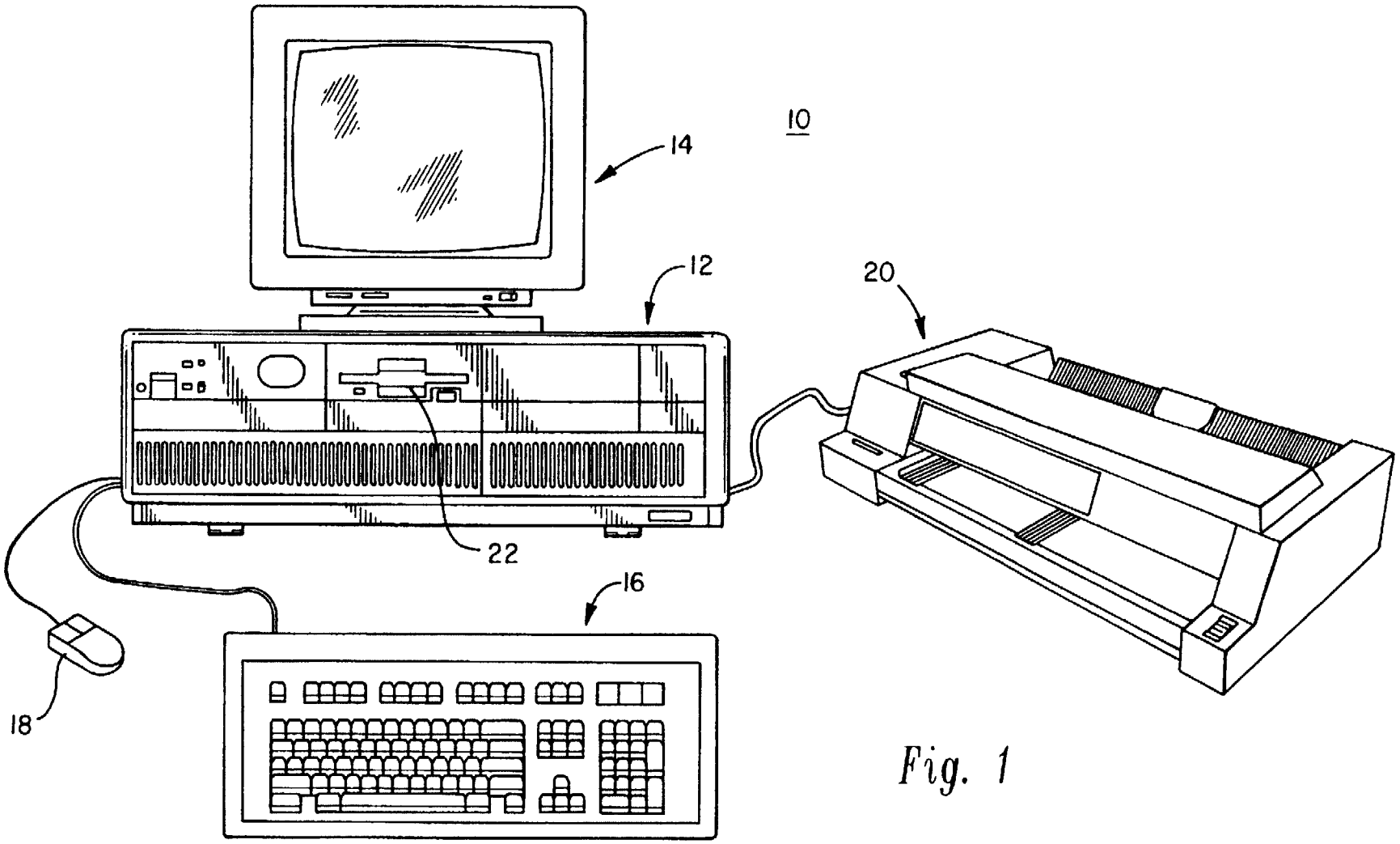
FIG. 1 depicts in accordance with an illustrative embodiment of the present invention, a data processing system, personal computer system, in which the present invention can be employed.

Referring now to the figures, and in particular to FIG. 1, a data processing system, personal computer system 10, in which the present invention can be employed is depicted. As shown, personal computer system 10 comprises a number of components, which are interconnected together. More particularly, a system unit 12 is coupled to and can drive an optional monitor 14 (such as a conventional video display). A system unit 12 also can be optionally coupled to input devices such as a PC keyboard 16 or a mouse 18. Mouse 18 includes right and left buttons (not shown). The left button is generally employed as the main selector button and alternatively is referred to as the first mouse button or mouse button 1. The right button is typically employed to select auxiliary functions. The right mouse button is alternatively referred to as the second mouse button or mouse button 2. An optional output device, such as a printer 20, also can be connected to the system unit 12. Finally, system unit 12 may include one or more mass storage devices such as the diskette drive 22.

As will be described below, the system unit 12 responds to input devices, such as PC keyboard 16, the mouse 18, or local area networking interfaces. Additionally, input/output (I/O) devices, such as floppy diskette drive 22, display 14, printer 20, and local area network communication system are connected to system unit 12 in a manner well known. Of course, those skilled in the art are aware that other conventional components also can be connected to the system unit 12 for interaction therewith. In accordance with the present invention, personal computer system 10 includes a system processor that is interconnected to a random access memory (RAM), a read only memory (ROM), and a plurality of I/O devices.

In normal use, personal computer system 10 can be designed to give independent computing power to a small group of users as a server or a single user and is inexpensively priced for purchase by individuals or small businesses. In operation, the system processor functions under an operating system, such as IBM's OS/2 operating system or DOS. OS/2 is a registered trademark of International Business Machines Corporation. This type of operating system includes a Basic Input/Output System (BIOS) interface between the I/O devices and the operating system. BIOS, which can be stored in a ROM on a motherboard or planar, includes diagnostic routines which are contained in a power on self test section referred to as POST.

Prior to relating the above structure to the present invention, a summary of the operation in general of personal computer system 10 may merit review. Referring to FIG. 2, there is shown a block diagram of personal computer system 10 illustrating the various components of personal computer system 10 in accordance with the present invention. FIG. 2 further illustrates components of planar 11 and the connection of planar 11 to I/O slots 46*a*–46*d* and other hardware of personal computer system 10. Connected to planar 11 is the system central processing unit (CPU) 26 comprised of a microprocessor which is connected by a high speed CPU local bus 24 through a bus controlled timing unit 38 to a memory control unit 50 which is further connected to a volatile random access memory (RAM) 58. While any appropriate microprocessor can be used for CPU 26, one suitable microprocessor is the Power PC microprocessor, which is sold by IBM Corporation. "Power PC" is a trademark of IBM Corporation.

While the present invention is described hereinafter with particular reference to the system block diagram of FIG. 2, it is to be understood at the outset of the description which follows, it is contemplated that the apparatus and methods in accordance with the present invention may be used with other hardware configurations of the planar board. For example, the system processor could be an Intel 80386, 80486, or Pentium microprocessor. These particular microprocessors can operate in a real addressing mode or a protected addressing mode. Each mode provides an addressing scheme for accessing different areas of the microprocessor's memory.

Returning now to FIG. 2, CPU local bus 24 (comprising data, address and control components) provides for the connection of CPU 26, an optional math coprocessor 27, a cache controller 28, and a cache memory 30. Also coupled on CPU local bus 24 is a buffer 32. Buffer 32 is itself connected to a slower speed (compared to the CPU local bus) system bus 34, also comprising address, data and control components. System bus 34 extends between buffer 32 and a further buffer 36. System bus 34 is further connected to a bus control and timing unit 38 and a Direct Memory Access (DMA) unit 40. DMA unit 40 is comprised of a central arbitration unit 48 and a DMA controller 41. Buffer 36 provides an interface between the system bus 34 and a serial bus. Connected to bus 44 are a plurality of I/O slots 46*a*–46*d* for receiving adapter cards, which may be further connected to an I/O device or memory. In the depicted example, I/O slot 46*a* has a hard disk drive connected to it; I/O slot 46*b* has a CD-ROM drive connected to it; and I/O slot 46*c* has a ROM on an adapter card connected to it. An arbitration control bus 42 couples the DMA controller 41 and central arbitration unit 48 to I/O slots 46 and diskette adapter 82. Also connected to system bus 34 is a memory control unit 50 which is comprised of a memory controller 52, an address multiplexor 54, and a data buffer 56. Memory control unit 50 is further connected to a random access memory as represented by RAM module 58. Memory controller 52 includes the logic for mapping addresses to and from CPU 26 to particular areas of RAM 58. While the personal computer system 10 is shown with a basic 1 megabyte RAM module, it is understood that additional memory can be interconnected as represented in FIG. 2 by the optional memory modules 60 through 64.

A further buffer 66 is coupled between system bus 34 and a planar I/O bus 68. Planar I/O bus 68 includes address, data, and control components respectively. Coupled along planar bus 68 are a variety of I/O adapters and other peripheral components such as display adapter 70 (which is used to drive an optional display 14), a clock 72, nonvolatile RAM 74 (hereinafter referred to as "NVRAM"), a RS232 adapter 76, a parallel adapter 78, a plurality of timers 80, a diskette adapter 82, a PC keyboard/mouse controller 84, and a read only memory (ROM) 86. The ROM 86 includes BIOS which provides the user transparent communications between many I/O devices.

Clock 72 is used for time of day calculations. NVRAM 74 is used to store system configuration data. That is, the NVRAM will contain values which describe the present configuration of the system. For example, NVRAM 74 contains information which describe the capacity of a fixed disk or diskette, the type of display, the amount of memory, etc. Of particular importance, NVRAM 74 will contain data which is used to describe the system console configuration; i.e., whether a PC keyboard is connected to the keyboard/mouse controller 84, a display controller is available or the ASCII terminal is connected to RS232 adapter 76. Furthermore, these data are stored in NVRAM 74 whenever a special configuration program is executed. The purpose of the configuration program is to store values characterizing the configuration of this system to NVRAM 76 which are saved when power is removed from the system.

Connected to keyboard/mouse controller 84 are ports A and B. These ports are used to connect a PC keyboard (as opposed to an ASCII terminal) and mouse to the PC system. Coupled to RS232 adapter unit 76 is an RS232 connector. An optional ASCII terminal can be coupled to the system through this connector.

Specifically, personal computer system 10 may be implemented utilizing any suitable computer such as the IBM PS/2 computer or an IBM RISC SYSTEM/6000 computer, both products of International Business Machines Corporation, located in Armonk, N.Y. "RISC SYSTEM/6000" is a trademark of International Business Machines Corporation and "PS/2" is a registered trademark of International Business Machines Corporation.

The system is made aware of any particular device that requests external bitmap support. This is achieved during the loading of the drivers after the power on self test typically performed in a data processing system. Once the system knows that certain devices request external bitmap support, the system then copies the data received during a create or set bitmap bits operation and does not convert the image information to the internal format of the device. When a bitmap transfer occurs using one of these bitmaps, the system sends down to the original image data. Accordingly, the system allows that a 4 bit per pel (bpp) image carries a 16 entry color table with it, also, an 8 bpp carries a 256 color table with it, and a 24 bpp comes down in its 24 bpp format. This allows during queries and reads of the image that the requesting function receives the original image data.

To contrast the importance of the new approach with the prior art, a sample prior art implementation will be described first. In providing external bitmaps support, the system first generates or creates the desired bitmap after a GUI call, as illustrated in the flow diagram of FIG. 3. In block 302, the system, after a GUI call, creates a bitmap image in the device independent bits (DIB) format. The query bitmap bits application programming interface (API) undergoes a similar operation but in a device dependent bits (DSB) to DIB sequence. Next, in step 304, the system determines whether the device is a 24 bpp device and if not proceeds to step 306 where it determines whether the device is an 8 bpp device, and if not, proceeds to step 308, where it is determined that the device is a 4 bpp device.

If, in block 304, the device is a 24 bpp device, the system proceeds to block 310, where the system determines the original image bpp, whether it is 24 bpp, 8 bpp, or 4 bpp. If the image is 24 bpp, then the system proceeds to block 312 where the system converts the 24 DIB to a 24 DSB sequence and then outputs the image in the DSB format in block 314, thus preserving the color image in a 24 bpp DSB format. If the image is an 8 bpp image, the system, in block 316, converts the 8 bib to a 8 DIB format before outputting the image in block 314. Likewise, in block 318, the 4 bpp DIB image is converted to a 24 DSB format before outputting to storage or to the device in the DSB format.

If, in block 306, the system determines that the device destination requires 8 bpp, then the system proceeds to block 320 where an image conversion occurs much like that occurs in blocks 310–318. In this case, involving blocks 320–328, the image is converted from a 24 bpp, 8 bpp, or 4 bpp DIB format to an 8 DSB format in blocks 322, 324, or 326 respectively. Once the conversion of the image has been completed, the system proceeds to block 328 for outputting the image in the 8 bpp DSB format to the device destination or storage location.

If, in block 308, the system determines that the images to be forwarded to a 4 bpp device, the system proceeds to blocks 330–338, and follows much the same procedure as that in blocks 310–318 for converting the image into a 24 bpp format or in blocks 320–328 for converting the image to an 8 bpp format. For example, if the image is a 24 bpp DIB format, an 8 bpp DIB format, or 4 bpp DIB format, the system, in blocks 332, 334, or 336, respectively, convert the image to a 4 bpp DSB format before outputting the image to the device or for storage in block 338.

Figure 3:
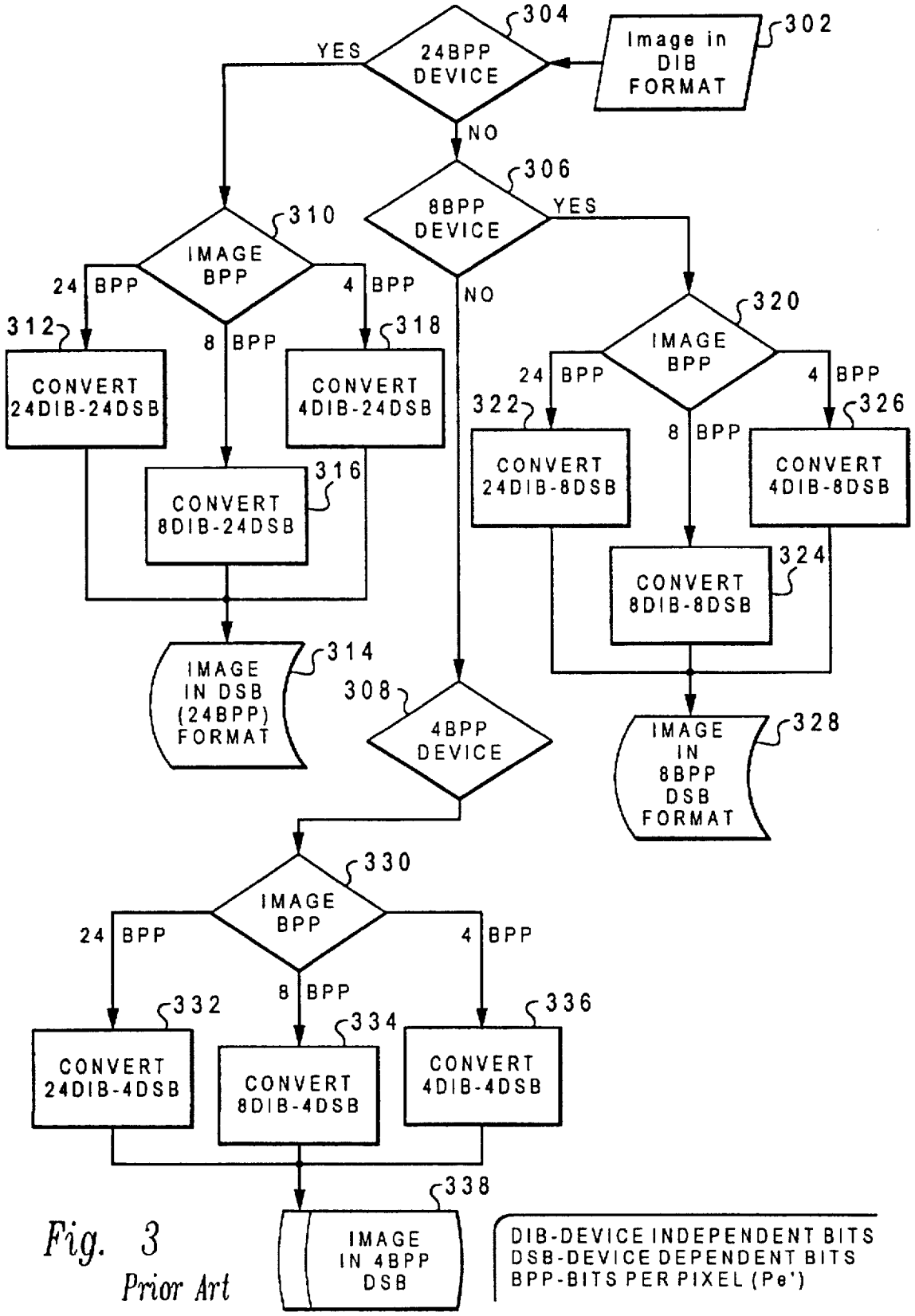
Fig. 3 Prior Art
FIG. 3 depicts a flow chart of a prior bit method of providing external bitmaps support.
Figure 4:
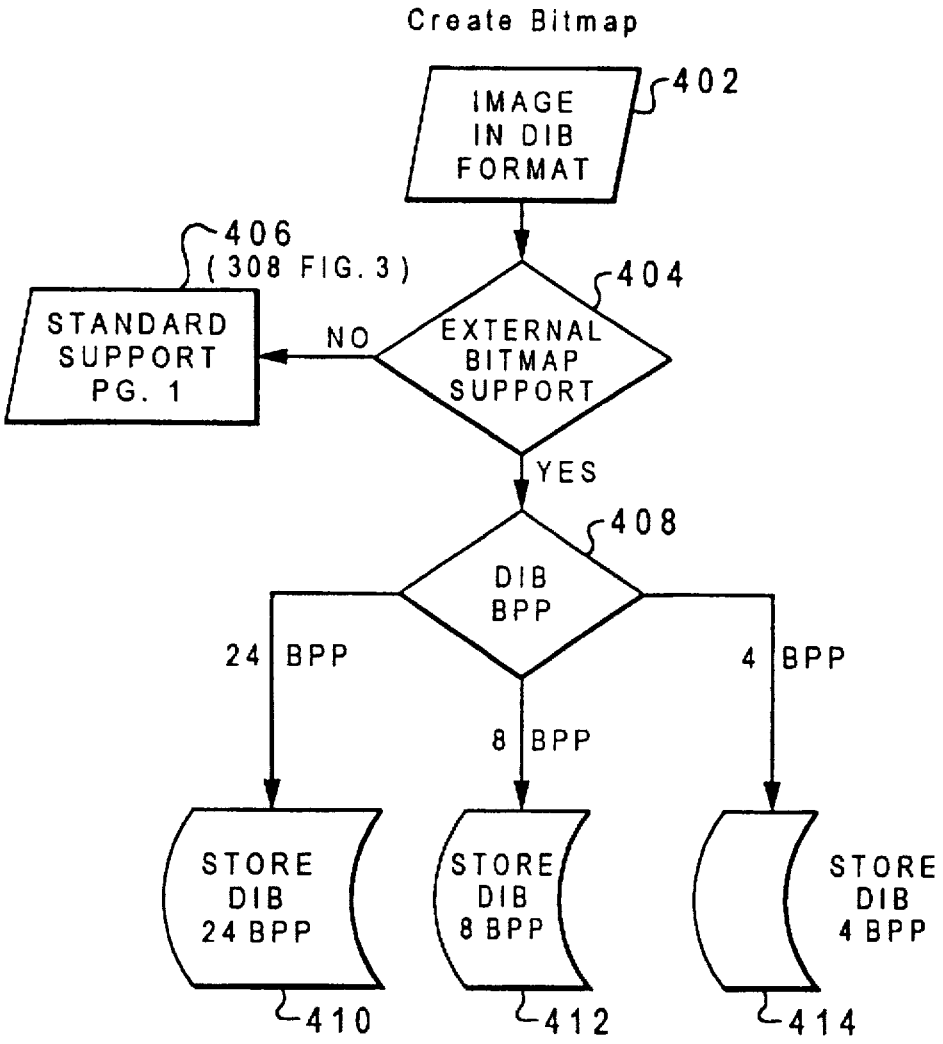
FIG. 4 is a flow chart of a method for providing external bitmap support for devices that support multiple image formats according to the present invention.

A simplified, more straight forward implementation of the create bitmap routine provided by the system is depicted in the flow chart of FIG. 4. FIG. 4 shows how the system provides external bitmap support for devices that support multiple image formats in hardware systems and provides new system support. In block 402, the system generates an image, through the GUI, in the original image format. Next, in block 404, the system determines whether the image should be supported in an external bitmap form. If not, in block 406, the system converts the image according to the standard support routine as depicted in FIG. 3. Otherwise, the system proceeds to block 408 where the image is shared in its original bpp format. If the conversion is to be 24 bpp, the system proceeds to block 410 and stores the image in DIB format at 24 bpp. If the image is to be stored at 8 bpp, in block 412, the image is stored in DIB format at 8 bpp. If, in block 414, the image is to be stored at 4 bpp, the image is stored in DIB format at 4 bpp.

This routine eliminates other conversion routines typically required to support multiple image formats while creating bitmap and query data back from the bitmap. Additionally, the routine minimizes storage requirements and that extra storage is not required to preserve the original bitmap color data.

Figure 5:
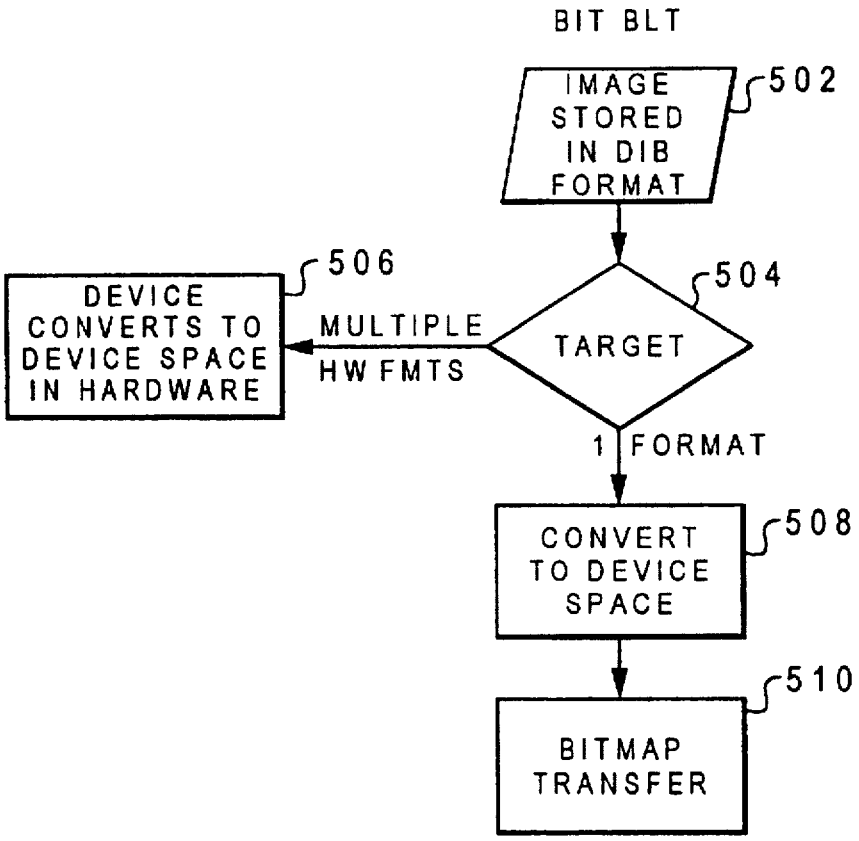
FIG. 5 depicts a flow diagram of a routine that shows how the image is actually passed to the driver according to the present invention.

FIG. 5 represents a flow diagram of a routine that shows how the image is actually passed to the driver. In block 502, the system retrieves the image stored in its original FMT format. Next, in step 504, the system determines which device is being targeted. If the device is being targeted for multiple hardware formats, the system proceeds to block 506, otherwise, the system proceeds to block 508. In block 506, the system converts to DSB in the hardware. In this step, the hardware performs image conversion from DIB to DSB format.

If the targeted device requires but one format, the system, in block 508, converts the image to the appropriate device space targeted. Next, in block 510, the system performs a bitmap transfer on the image appropriate for the destined device. The system then passes devices specific data to the device. This is necessary when a different device other than the one the image was created for is the recipient of an image in internal format.

The system, by providing external bitmap support, can also be used to postpone dithering. For example, the bitmap can retain original image colors until the bitmap is outputted to the desired device. On output, the system checks for the appropriate external format, if the format differs from the device format, and the device requested system dithering, then the system provides dithering from the image format to the device format. Alternatively, nearest color mapping may be substituted at this stage. For example, if we are using a mono-color device and the application has generated a 24 bpp, 8 bpp, or 4 bpp bitmap, any request to extract the image data results in the original image data, but when the 24 bit per pell image is transferred to the device, the system performs dithering from the original data to a monochrome. To preserve image colors the system need not convert to the color depths max common denominator, thus minimizing performance penalties normally incurred when preserving 24 bpp images when bitmap transferring 4 bpp or 8 bpp images.

The system is able to perform complex renderings. Specifically, the system enables complex primitives to be rendered to an external bitmap or translating a bitmap from one device to another or both. Before, these situations were normally handled by the system independently, thus it was the systems responsibility to manage any conflicts. Now, the system converts the image to an internal representation of the device. For example, a given external bitmap associated to an 8 bpp device, using its own 256 color table, and a separate application wants to bitmap transfer another image with a different set of 256 colors creates a conflict as to which color table will be used. The system resolves the conflict by either converting or dithering both images to a default color table provided by the destined driver. Another example is where the user desires to bitmap transfer an image created on a device that requests external bitmap format to a device that does not. Again, the system either maps or dithers the image to a desired device color table as in FIGS. 4 and 5.

The application of this method enables several different types of drivers to be eliminated. For example Omni Monochrome™ drivers use external support in conjunction with the system with system provided dithering to have the system dither the image with the original image color data. Likewise, laser jet drivers, post script drivers, and plotter drivers use external support for obtaining the bitmap bits in external format and then downloading them to their associated hardware. This external to internal and internal to external translation costs are eliminated by the external bitmap support method according to the present invention.

While the invention has been particularly shown and described with reference to a preferred embodiment, it will be understood by those skilled in the art that various changes in form and detail may be made therein without departing from the spirit and scope of the invention.

It is claimed:

1. In a data processing system having a central processing unit, memory, user output device, and a user input device, a method for providing external bitmap support to a device driver coupled to said data processing system, for outputting an image under a graphical user interface comprising the steps of:

generating a bitmap image through said graphical user interface in device independent bits format;

determining whether said bitmap image is to be supported in an external bitmap format;

if said bitmap image is to be supported in an external bitmap format, determining a level of resolution for supporting said bitmap image; and converting said bitmap image to said external bitmap format at said desired resolution.

2. The method according to claim 1 wherein said level of resolution is 24 bits per PEL.

3. The method according to claim 1 wherein said level of resolution is 8 bits per PEL.

4. The method according to claim 1 wherein said level of resolution is 4 bits per PEL.

5. The method according to claim 1 wherein if said bitmap image is not to be supported in an external bitmap format converting said bitmap image using internal bitmap support.

6. The method according to claim 1 further comprising the steps of:

determining whether said bitmap image is targeted for multiple hardware formats or a single hardware format;

if said bitmap image is targeted for multiple hardware formats, performing image conversion from device independent bits format to device dependent bits format;

forwarding said converted bitmap image to either multiple hardware devices or a single hardware device; and if said bitmap image is targeted to a single hardware format, performing image conversion appropriate for said single hardware format.

7. A data processing system having a central processing unit, memory, user output device, and a user input device, and including a system for providing external bitmap support to a device driver coupled to said data processing system, for outputting an image under a graphical user interface comprising:

means for generating a bitmap image through said graphical user interface in device independent bits format;

means for determining whether said bitmap image is to be supported in an external bitmap format;

means for determining a level of resolution for supporting said bitmap image; and means for converting said bitmap image to said external bitmap format at said desired level of resolution.

8. The system according to claim 7 wherein said level of resolution is 24 bits per PEL.

9. The system according to claim 7 wherein said level of resolution is 8 bits per PEL.

10. The system according to claim 7 wherein said level of resolution is 4 bits per PEL.

11. The system according to claim 7 further comprising:

means for determining whether said bitmap image is targeted for multiple hardware formats or a single hardware format;

means for performing image conversion from device independent bits format to device dependent bits format;

means for performing image conversion appropriate for said single hardware format; and means for forwarding said converted bitmap image to either multiple hardware devices or a single hardware device.

12. A computer program product for use with a graphics display device, said computer program product comprising:

a computer usable medium having computer readable program code means for providing external bitmap support to a device driver coupled to a data processing system for outputting an image under a graphical user interface displayable on said graphics display device further comprising:

computer readable program code means for causing a computer to generate a bitmap image through said graphical user interface in device independent bits format;

computer readable program code means for causing a computer to determine whether said bitmap image is to be supported in an external bitmap format;

computer readable program code means for causing a computer to, if said bitmap image is to be supported in an external bitmap format, determine a level of resolution for supporting said bitmap image; and computer readable program code means for causing a computer to convert said bitmap image to said external bitmap format at said desired level of resolution.

13. The computer program product according to claim 12 wherein said level of resolution is 24 bits per PEL.

14. The computer program product according to claim 12 wherein said level of resolution is 8 bits per PEL.

15. The computer program product according to claim 12 wherein said level of resolution is 4 bits per PEL.

16. The computer program product according to claim 12 further comprising computer readable code means for converting said bitmap image using internal bitmap support.

17. The computer program product according to claim 12 further comprising:

computer readable program code means for determining whether said bitmap image is targeted for multiple hardware formats or a single hardware format;

computer readable program code means for performing image conversion from device independent bits format to device dependent bits format;

computer readable program code means for performing image conversion appropriate for said single hardware format; and computer readable program code means for forwarding said converted bitmap image to either multiple hardware devices or a single hardware device.

* * * * *

UNITED STATES PATENT AND TRADEMARK OFFICE

CERTIFICATE OF CORRECTION

PATENT NO. : 5,767,833
DATED : June 16, 1998
INVENTOR(S) : Vanderwiele et al.

It is certified that error appears in the above-identified patent and that said Letters Patent is hereby corrected as shown below:

On the title page;
In Attorney, Agent, or Firm: Please change "Dillion" to --Dillon--

Signed and Sealed this

Twelfth Day of January, 1999

*Attest:*

*Attesting Officer*

*Acting Commissioner of Patents and Trademarks*